US006776594B1

(12) United States Patent
Heng-I et al.

(10) Patent No.: US 6,776,594 B1
(45) Date of Patent: Aug. 17, 2004

(54) ROTOR MECHANISM

(75) Inventors: Lin Heng-I, Tu-Cheng Shih Taipei Hsien (TW); Chuang Feng-Ming, Tu-Cheng Shih Taipei Hsien (TW)

(73) Assignee: Liung Feng Industrial Co., Ltd., Taipei Hsien (TW)

( * ) Notice: Subject to any disclaimer, the term of this patent is extended or adjusted under 35 U.S.C. 154(b) by 0 days.

(21) Appl. No.: 10/449,080

(22) Filed: Jun. 2, 2003

(51) Int. Cl.[7] ..... F01C 1/24
(52) U.S. Cl. ..... 418/206.5; 418/191
(58) Field of Search ..... 418/206.5, 191

(56) References Cited

U.S. PATENT DOCUMENTS

| | | | | | |
|---|---|---|---|---|---|
| 1,426,820 | A | * | 8/1922 | Crawford | 418/191 |
| 4,324,538 | A | * | 4/1982 | Brown | 418/191 |
| 4,406,601 | A | * | 9/1983 | Towner | 418/191 |
| 4,430,050 | A | * | 2/1984 | Blazejewski | 418/191 |
| 5,149,256 | A | * | 9/1992 | Schmitz | 418/191 |

FOREIGN PATENT DOCUMENTS

| | | | | | |
|---|---|---|---|---|---|
| EP | 009915 | A1 | * | 4/1980 | 418/191 |
| EP | 456352 | A1 | * | 11/1991 | F01C/1/08 |
| JP | 04350301 | A | * | 12/1992 | F01C/1/20 |

* cited by examiner

*Primary Examiner*—Thomas Denion
*Assistant Examiner*—Theresa Trieu
(74) *Attorney, Agent, or Firm*—Troxell Law Office PLLC

(57) ABSTRACT

The present invention provides an improved rotor mechanism to improve the mechanism of the intermeshing displacement rotor and valve rotor. The main feature is that the displacement rotor and the valve rotor provide the operation curve from the carryover period to intake period, which includes a pair of convex curves with different radius merging smoothly with each other, thereby providing a smooth transference of the intake, exhaust, and carryover, etc. and avoiding noise and vibration during the working process. Moreover, the displacement rotor and the valve rotor provide the operation curve from the starting of exhaust to the period of ending, which is defined by an arcuated surface thereby providing a rotor mechanism with great diplacement transference and high compression ratio.

7 Claims, 9 Drawing Sheets

ROTOR MECHANISM

BACKGROUND OF THE INVENTION

1. Field of the Invention

The present invention relates to a rotor mechanism, more particularly, an improved rotor mechanism used in vacuum systems like a vacuum pump, an air compressor, a compressor, and those machines which includes a periodic compression operation of intake and exhaust, thereby providing enhancing those machines a high compression ratio and a smooth intake and exhaust process and avoiding noise and vibration.

2. The Prior Art

Referring to the U.S. Pat. Nos. 4,138,838, 4,224,016, 4,324,538, 4,430,050 and 5,149,256, the double lobes type rotor of multi-phases roots type compressor or vacuum pump relates to the present invention. Such double lobes type rotor mechanism comprises a pair of the intermeshing displacement rotor and valve rotor. A pair of lobes of each rotor provides periodic compression operation of air intake and air exhaust. Therefore, when intermeshing, the inosculation of two lobes of the rotors is very important. If the inosculation of the two lobes of the rotors is not good enough, noise and vibration may occur during the periodic air intake, air exhaust, and non-compression of the rotors. Moreover, wear may occur due to the improper intermeshing of the rotors thereby reducing the production useful life. The above-mentioned U.S. Pat. No. 5,149,256 obviously has those defects. Referring to FIG. 10, the lobes of a pair of rotors 8, 9 of U.S. Pat. No. 5,149,256 includes the tip portions 82, 92 formed at the junctions between the concave portions 80, 90 and the arcuated surface 81, 91 so that there is discontinuity of the rotors 80, 90's curves at the tip portion 82, 92. Therefore, during the moments from inefficient compression period to the period of air's starting intake, the top portions 83, 93 of the rotors 8, 9 will operate unsmoothly at the tip portion 82, 92 thereby resulting in noise and vibration.

SUMMARY OF THE INVENTION

To overcome those defects of the double lobes type rotor of the prior art, the object of the present invention is to provide an improved rotor mechanism which could operate smoothly and avoid noise and vibration during the periodic operation of intake, exhaust, and carryover, etc.

Another object of the improved rotor mechanism of the present invention is to provide an improved rotor mechanism which provides great displacement transference and high compression ratio to achieve the vacuum demanded for vacuum system by fewer stages of rotor sets in series. Therefore, such a improved rotor mechanism is cost efficient.

To fulfill the above-mentioned objects, the improved rotor mechanism of the present invention includes an improvement on the structure of the intermeshing displacement rotor and valve rotor, that is, to provide the two rotors a smooth operation curve during the carryover period. The main feature is that the operation curve provided by the displacement rotor and the valve rotor from the carryover period to the period of starting intake is defined by a couple of smoothly connected different curves rather than a couple of connected arcs.

Another feature of the improved rotor mechanism of the present invention is that the operation curve from the period of starting air intake to the period of ending provided by the displacement rotor and the valve rotor is defined by an arcuated surface thereby providing great displacement transference and high compression ratio.

DETAILED DESCRIPTION OF THE PREFERRED EMBODIMENTS

Figure 1:
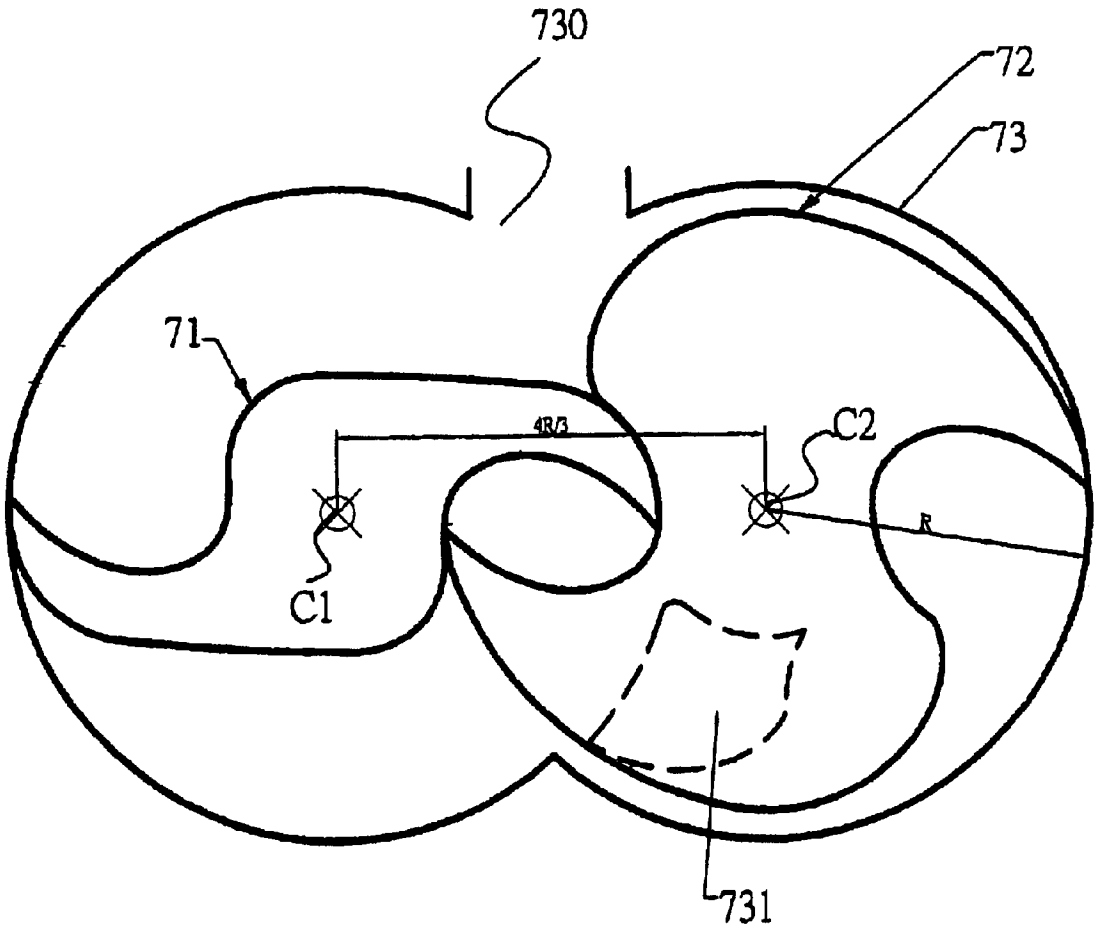
FIG. 1 is the perspective view of the displacement rotor and valve rotor of the present invention which are assembled within the cavity portion.
Figure 5:
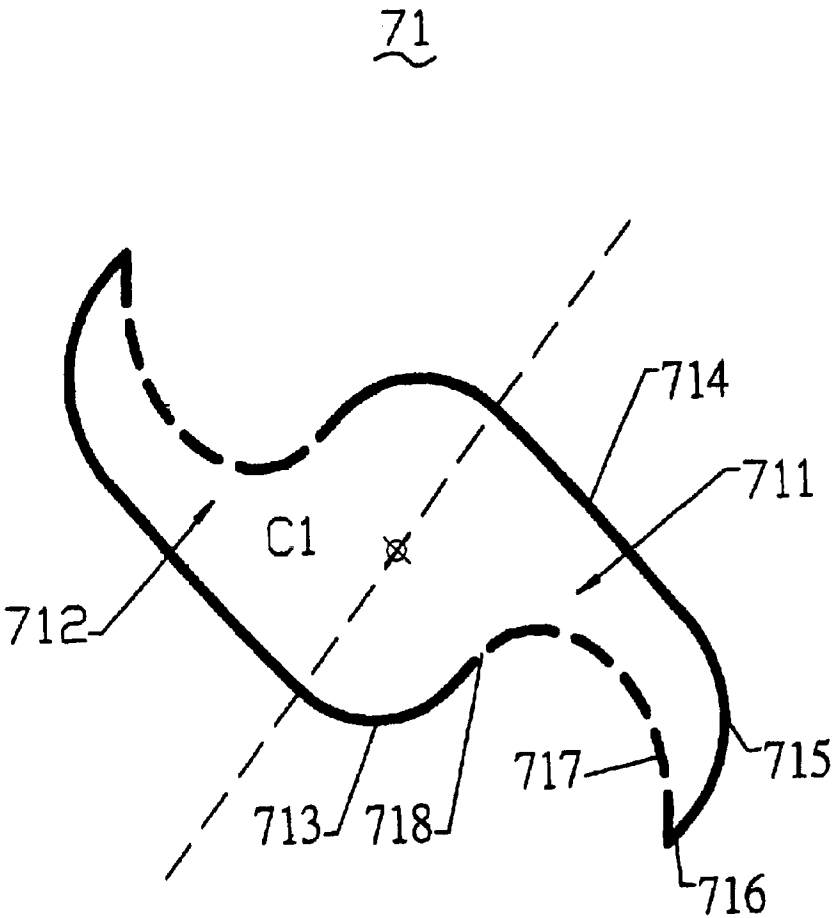
FIG. 5 is the planar view of the displacement rotor of the present invention.

Referring to FIG. 1, a rotor mechanism of the present invention comprises a pair of intermeshing displacement rotor 71 and valve rotor 72. The rotors 71, 72 are accommodated within a cavity portion 73. The cavity portion 73 includes an inlet 730 and an outlet 731. The valve rotor 72 is disposed adjacent to the outlet 731 and is rotatable to occlude or open the outlet 731. Also referring to FIG. 5, the displacement rotor 71 of the present invention includes a pair of lobes 711, 712 which has the same structure and is symmetrical about a rotary hub C1. For facilitating the description and avoid the complexity of drawings, only the lobe 711 shall be described about the designated detailed structures as follows. The lobe 711 includes a first arcuated surface 713 to provide the operation process from air intake starting period to the period of ending, a second arcuated surface 714 corresponding to the first arcuated surface 713 to provide the operation process from the period of air exhaust starting to the period of ending, and a third arcuated surface 715, a fourth arcuated surface 716, a first convex surface 717, a second convex surface 718. The first and second convex surfaces 717, 718 are connected between the first arcuated surface 713 and the second arcuated surface 714 to provide an operation process of carryover. The third arcuated surface 715 is smoothly connected with the second arcuated surface 714. The fourth arcuated surface 716 is connected between the third arcuated surface 715 and the the first convex surface 717. The second convex surface 718 is connected between the first convex surface 717 and the first arcuated surface 713.

Figure 6:
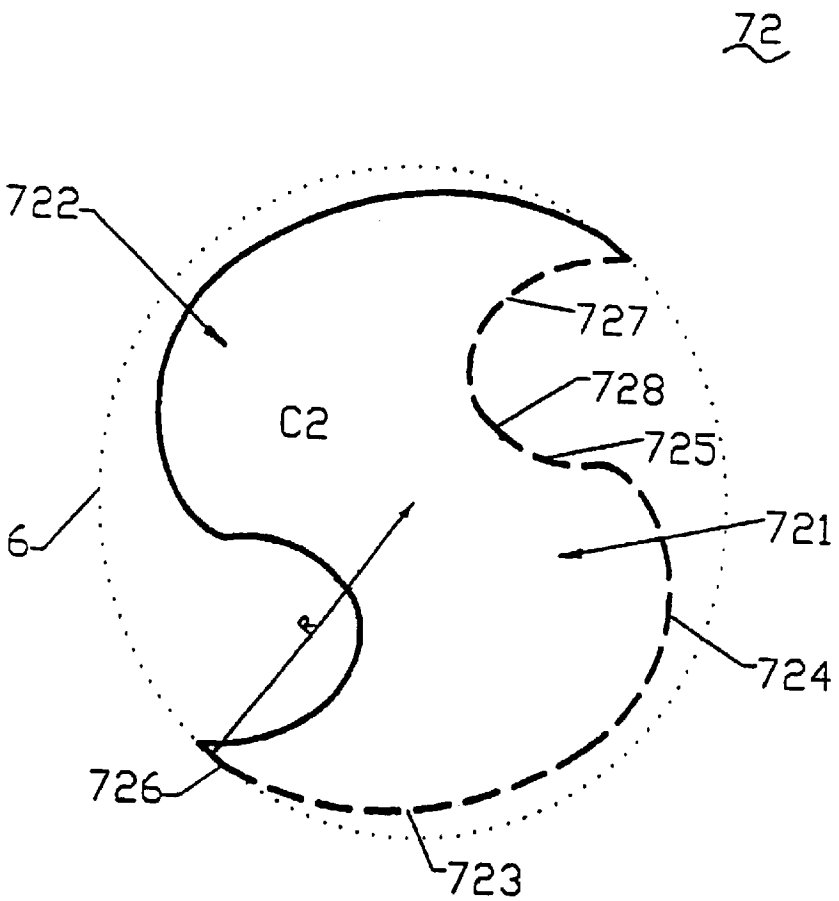
FIG. 6 is the planar view of the valve rotor of the present invention.
Figure 7C:
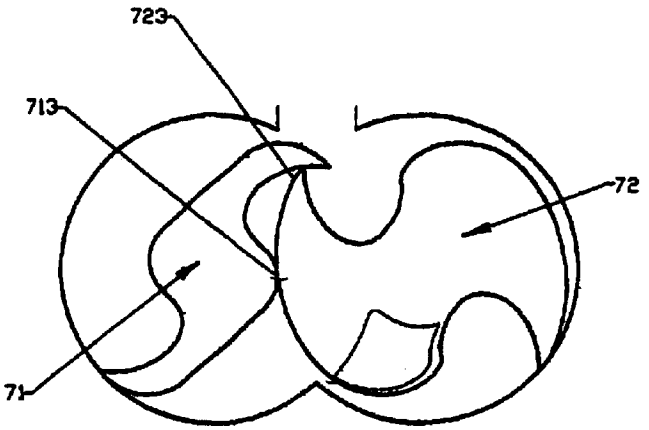
FIGS. 7A to 7D, FIGS. 8A to 8D and FIG. 9 are the perspective views of the periodic operation of the intake, the exhaust and the carryover, etc. of the displacement rotor and the valve rotor of the present invention.
Figure 7D:
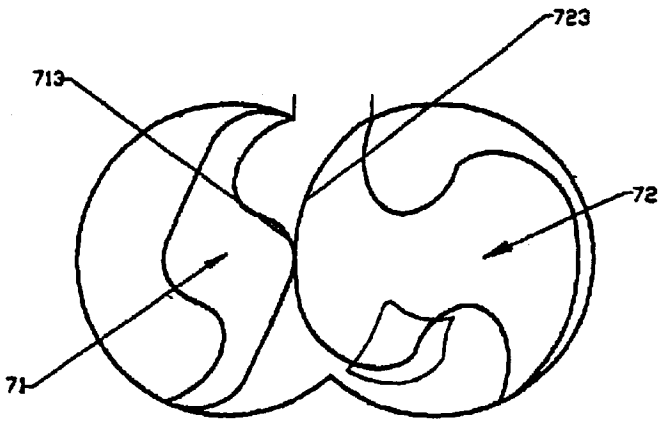
Figure 7A:
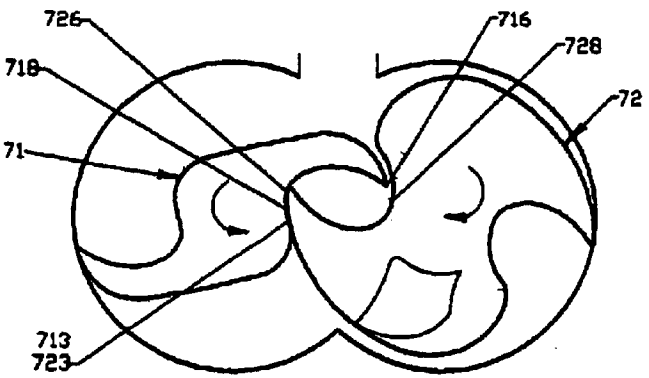
Figure 7B:
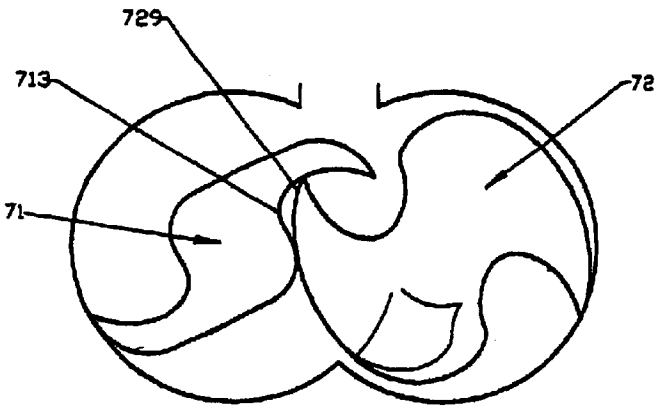
Figure 8A:
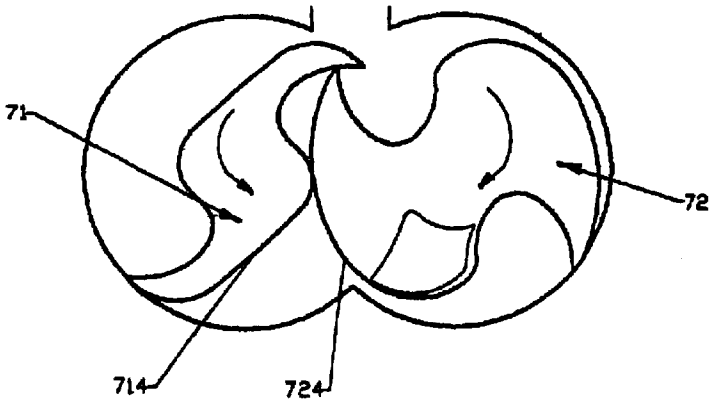
Figure 8B:
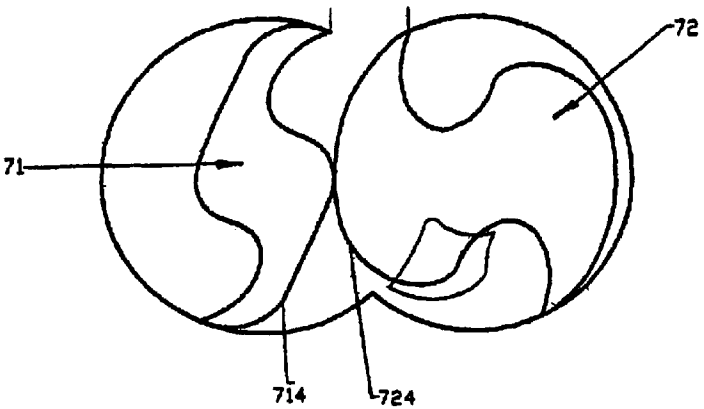
Figure 8C:
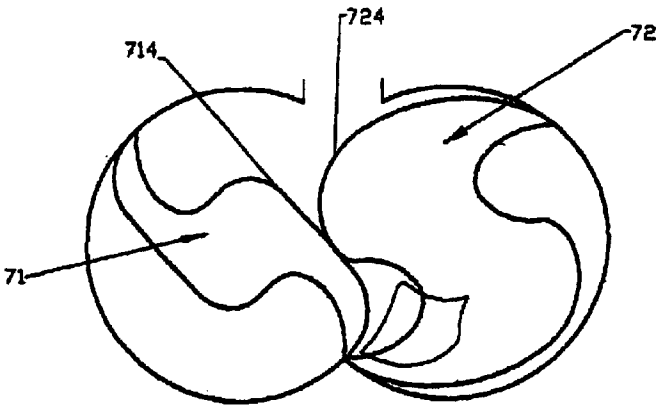
Figure 8D:
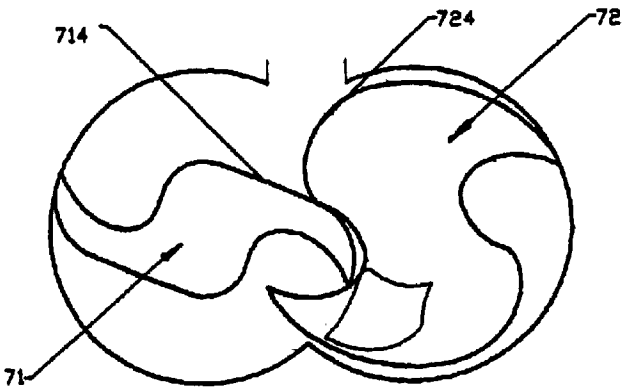

Referring to FIG. 6, the valve rotor 72 includes a pair of lobes 721, 722 which has the same structure and is symmetrical about a rotary hub C2. Each lobe 721, 722 includes the corresponding arcuated surfaces 723, 724, 725, 726 and the convex surfaces 727, 728 which is defined by the relative rotation movement of the arcuated surfaces 713, 714, 715, 716, and the convex surfaces 717, 718 and intermeshes with the arcuated surfaces 713, 714, 715, 716, and the convex surfaces 717, 718 (For facilitating the description and avoid the complexity of drawings, only the lobe 721 shall be described about the designated detailed structures as following.)

The arcuated surfaces and the convex surfaces of the displacement rotor 71 are defined in an ordinal manner, i.e. the third arcuated surface 715, the fourth surface 716, the first convex surface 717, the second convex surface 718, the first arcuated surface 713, and the second arcuated surface 714. The description for defining each arcuated surface and convex surface is as follows.

Figure 3:
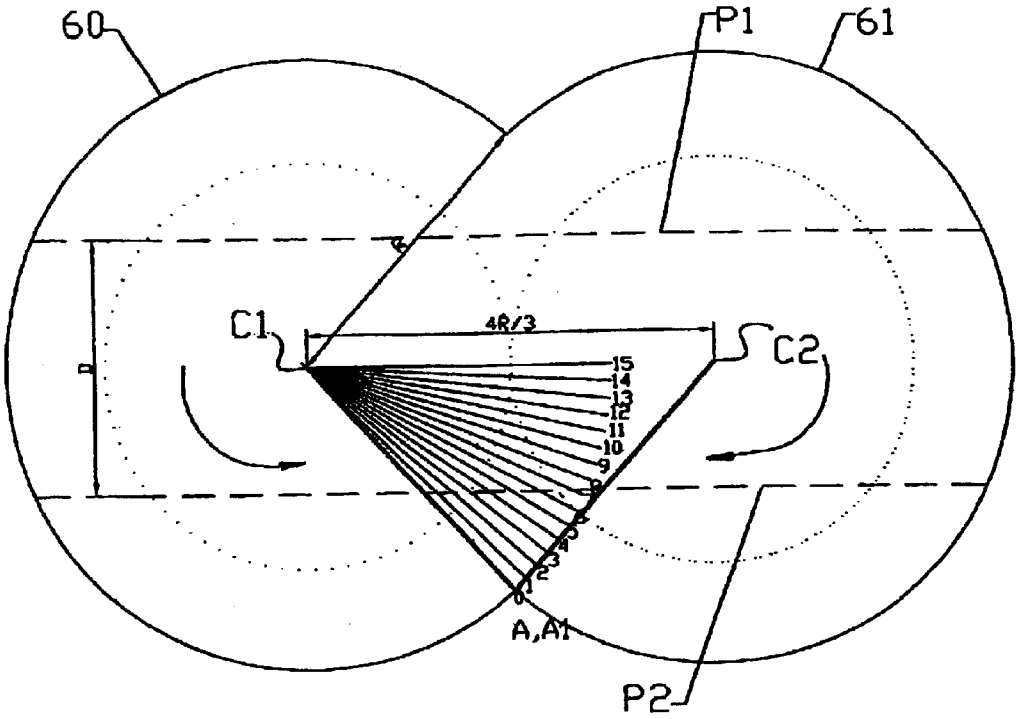
FIGS. 3, 4 are the perspective views of the corresponding rotation movement of the displacement rotor and the valve rotor about the hub.
Figure 4:
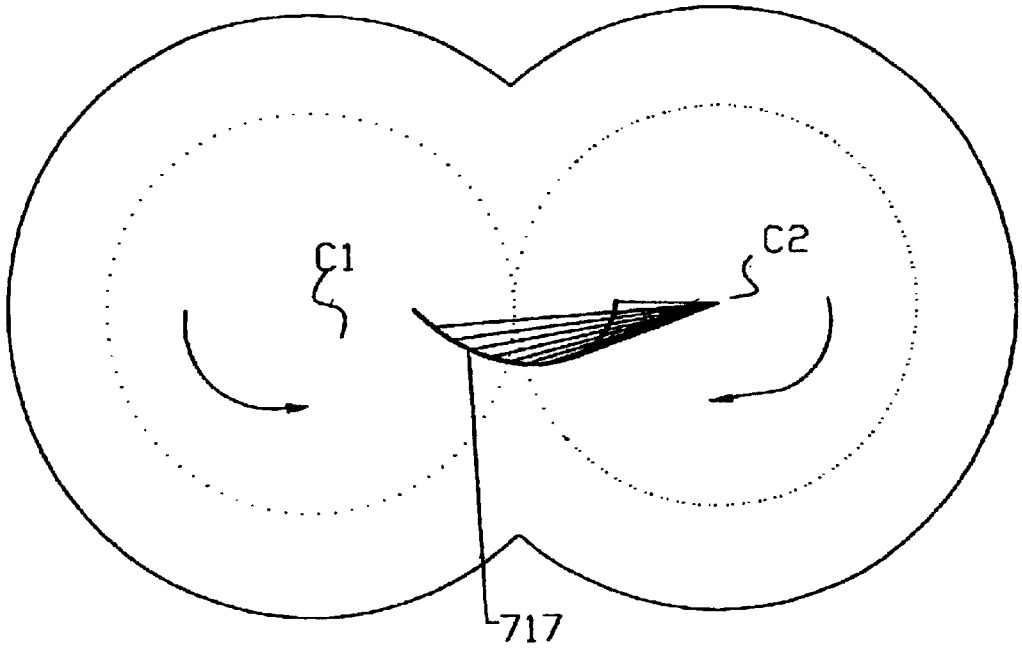

1. Referring to FIG. 3, the maximum external radius of the displacement rotor 71 and the valve rotor 72 is designated R. The distance between the centers of the hubs C1, C2 of the rotors is designated 4R/3. A pair of parallels P1, P2 is defined as drawing assistant lines. A pair of rounds 60, 61 are respectively drawn out with the maximum radius R and circle center C1, C2.

Figure 2:
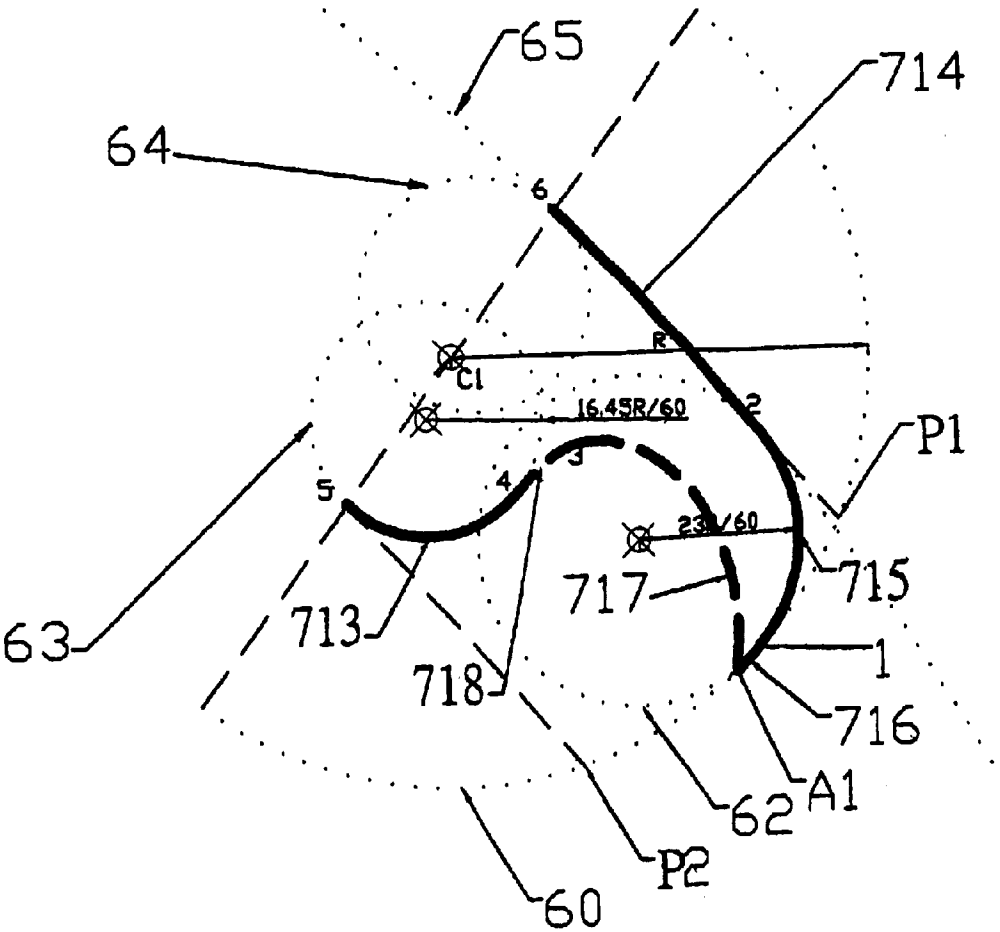
FIG. 2 is the planar view of one lobe of the displacement rotor of the present invention.

2. Referring to FIG. 2 again, a third arcuated surface 715 is defined by a round 62 which has a radius of 23R/60 and is tangent to both the round 60 defined by the maximum external radius of the displacement rotor and the parallel P1. The surface on the round 62 which is between the point of tangency 1 of the round 62 and the round 60 defined by the maximum external radius of the displacement rotor, and the point of tangency 2 of the round 62 and the parallel P1, is the third arcuated surface 715.

3. The fourth surface 716 is defined by the point of tangency 1 of the third arcuated 715 and the round 60 defined by the maximum external radius of the displacement rotor, the tip portion A1 defined by the corresponding rotation movement of the two rotors about the hubs (Referring to FIG. 3, the two tip portions A, A1 are defined by the corresponding rotation movement of both the maximum external radius R of the two rotors 71, 72 about the hubs C1, C2.). The surface of the round 60 defined by the maximum external radius of the displacement rotor which is between the tip portion A1 and the point of tangency 1 is the fourth arcuated surface 716.

4. After the fourth arcuated surface 716 is defined, the convex surface which is defined by the corresponding rotation movement of the tip portion A1 cooperating with the tip portion A of the valve rotor 72 with the above-mentioned the maximum external radius R of the two rotors 71, 72, as the radius about the hubs C1, C2 is the first convex surface 717.

5. The second convex surface 718 is defined by the corresponding rotation movement of the fourth arcuated surface 716 about the hubs C1, C2 of the two rotors 71, 72, respectively.

6. The first arcuated surface 713 is defined as follows. A round 63 with a radius of 16.45R/60 is defined to be tangent to both the second convex surface 718 and the parallel P2. The surface which is between the point of tangency 4 of the round 63 and the second convex surface 718, and the point of tangency 5 of the round 63 and the parallel P2 is the first arcuated surface 713.

7. The second arcuated surface 714 is defined as follows. The enantiomorphous round 64 is defined by the 180 degree rotation of the round 63 which defines the first arcuated surface 713 about the hub C1 of the displacement rotor. Moreover, another round 65 with the radius of 20R/3 is defined to be tangent to both the above-mentioned enantiomorphous round 64 and the third arcuated surface 715. The surface which is between the point of tangency 6 of the round 65 and the enantiomorphous round 64, and the point of tangency 2 of the round 65 and the third arcuated surface 715 is the second arcuated surface 714.

Figure 9:
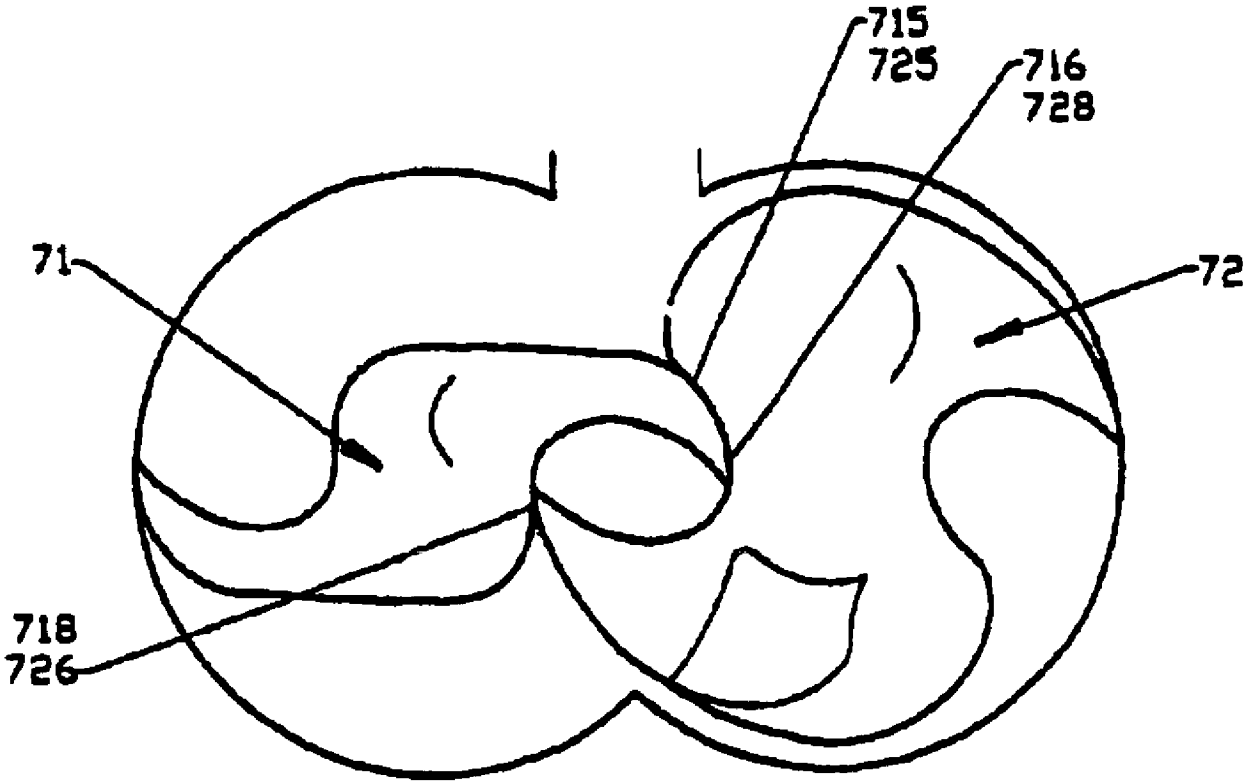
Figure 10:
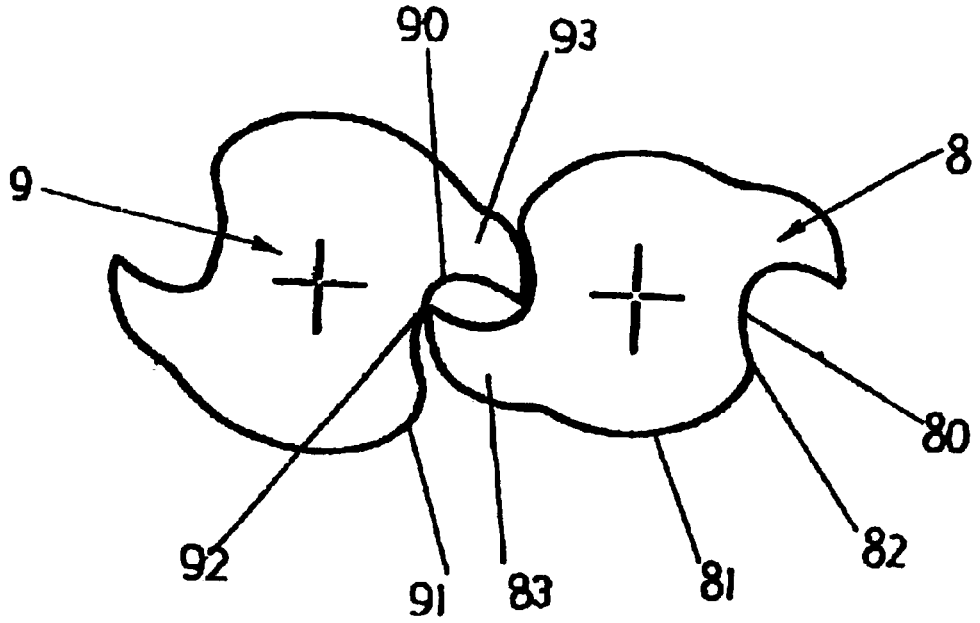
FIG.10 PRIOR ART
FIG. 10 is the planar view of the intermeshing double lobes type rotor of the U.S. Pat. No. 5,149,256.

Also referring to FIG. 7A to FIG. 7D, FIG. 8A to FIG. 8D, and FIG. 9, the period of the intake, exhaust and carryover of the displacement rotor 71 and valve rotor 72 of the present invention is described. Referring to the FIG. 7A to FIG. 7D, from the period of starting intake to the period of ending, the first arcuated surface 713, 723 of the displacement rotor 71 and the valve rotor 72 provide the whole operation process. Referring to FIG. 8A to FIG. 8D, from the period of starting exhaust to the period of ending, the second arcuated surface 714, 724 of the displacement rotor 71 and the valve rotor 72 provide the whole operation process. Referring to FIG. 9, during the period of carryover the third arcuated surfaces 715, 725, the fourth arcuated surfaces 716, 726, the first convex surfaces 717, 727, and the second convex surfaces 718, 728 of the displacement rotor 71 and valve rotor 72 provide the whole operation process. It should be noted that (referring to FIG. 9 and FIG. 7A) during the transition of the present invention from the carryover to intake, the second convex surfaces 718, 728 smoothly operate corresponding to the first convex surfaces 717, 727 so that no noise or vibration would occur during the operation. The second arcuated surfaces 714, 724 provide great displacement transference and high compression ratio, which is over 3 times higher than the compression ratio of the conventional Roots rotors. Moreover, during the simulating process of the rotors of the present invention, the maximum gas intake volume and the minimum volume of the rotor compression limit could be calculated. The carryover volume, etc. of the rotor during the operation could be evaluated. According to the theory of polytropic process of classic thermodynamics, the theoretic single stage compression ratio of the double lobes type rotor of the present invention is about 29 with air as the inlet material and is much higher than the compression ratio of the conventional Roots pump which is 2~8, while discharging to atmosphere.

While the rotor mechanism of the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

What is claimed is:

1. An improved rotor mechanism comprising a structure of intermeshing displacement rotor and valve rotor, the displacement rotor including a pair of lobes which has the same structure and is symmetrical about a rotary hub, each lobe including:

a first arcuated surface providing an operation process from intake starting period to the period of ending;

a second arcuated surface corresponding to the first arcuated surface to provide the operation process from exhaust starting period to the period of ending; and a third arcuated surface, a fourth arcuated surface, a first and a second convex surfaces which are connected between the first arcuated surface and the second arcuated surface to provide an operation process of carryover, the third arcuated surface being connected with the second arcuated surface, the fourth arcuated surface being connected between the third arcuated surface and the first convex surface, and the second convex surface being connected between the first convex surface and the first arcuated surface;

the valve including a pair of lobes which has the same structure and is symmetrical about a rotary hub, each lobe including the corresponding arcuated surfaces and the convex surfaces which is defined by the relative rotation movement of the arcuated surfaces and the convex surfaces of the displacement rotor, and intermeshes with the arcuated surfaces and the convex surfaces of the displacement rotor, during the operation process from carryover period to the period of starting intake, the displacement rotor and the valve rotor being smoothly connected at the first and second convex surfaces, thereby providing the smooth and unhindered operation of the two rotors, wherein a maximum external radius of the displacement rotor and the valve rotor is designed R, a distance between the centers of the hubs of the two rotors is 4R/3, a pair of parallels being defined as drawing assistant lines, the surface being defined by the corresponding movement of the two rotors with a pair of tip portions which is defined by the corresponding rotation movement of the hubs of the two rotors as the operation ends and with the maximum external radius is the first convex surface.

2. The improved rotor mechanism as claimed in claim 1, wherein the arcuated surfaces and the convex surfaces of the displacement rotor are defined in an ordinal manner, the third arcuated surface, the fourth surface, the first convex surface, the second convex surface, the first arcuated surface, and the second arcuated surface.

3. The improved rotor mechanism as claimed in claim 2, wherein a third arcuated surface is defined adjacent to the first convex surface by a first round with a radius of 23R/60 being defined to be tangent to both a second round defined by the maximum external radius of the displacement rotor and a first parallel of the two parallels, the surface on the first round which is between a first point of tangency of the first round and the second round defined by the maximum external radius of the displacement rotor and a second point of tangency of the first round and the first parallel of the two parallels being the third arcuated surface.

4. The improved rotor mechanism as claimed in claim 3, wherein the fourth surface is defined by the first point of tangency of the third arcuated surface and the second round defined by the maximum external radius of the displacement rotor, and a first tip portion of the two tip portions defined by the corresponding rotation movement of the two rotors bout the hubs, the surface of the second round defined by the maximum external radius of the displacement rotor which is between the first tip portion and the first point of tangency being the fourth arcuated surface.

5. The improved rotor mechanism as claimed in claim 4, wherein the second convex surface is defined by the corresponding rotation movement of the fourth arcuated surface about the hubs of the two rotors, respectively.

6. The improved rotor mechanism as claimed in claim 5, wherein a third round with a radius of 16.45R/60 being defined to be tangent to both the second convex surface and one a second parallel of the two parallels, the surface which is between a third point of tangency of the third round and the second convex surface and a fourth point of tangency of the third round and the second parallel being the first arcuated surface.

7. The improved rotor mechanism as claimed in claim 6, wherein an enantiomorphous round is defined by the 180 degree rotation of the third round which defines the first arcuated surface about the hub of the displacement rotor, moreover, a fourth round with the radius of 20R/3 being defined to be tangent to both the above-mentioned enantiomorphous round and the third arcuated surface, the surface which is between a fifth point of tangency of the fourth round and the enantiomorphous round, and the second point of tangency of the fourth round and the third arcuated surface being the second arcuated surface.

* * * * *